US011174586B2

(12) United States Patent
Prajescu et al.

(10) Patent No.: US 11,174,586 B2
(45) Date of Patent: Nov. 16, 2021

(54) VORTEX DRYER APPLIANCE

(71) Applicant: Haier US Appliance Solutions, Inc., Wilmington, DE (US)

(72) Inventors: Gabriel Neculai Prajescu, Louisville, KY (US); David Scott Dunn, Louisville, KY (US); Jivko Ognianov Djerekarov, Louisville, KY (US); Brian Michael Schork, Louisville, KY (US); Ionelia Silvia Prajescu, Louisville, KY (US); James Quentin Pollett, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 26 days.

(21) Appl. No.: 16/565,815

(22) Filed: Sep. 10, 2019

(65) Prior Publication Data

US 2021/0071346 A1 Mar. 11, 2021

(51) Int. Cl.
*D06F 58/20* (2006.01)

(52) U.S. Cl.
CPC ..... *D06F 58/20* (2013.01)

(58) Field of Classification Search
CPC ..... D06F 58/20; D06F 58/04; D06F 58/00; D06F 58/10; D06F 58/02; D06F 58/206
USPC ..... 34/595–610
See application file for complete search history.

(56) References Cited

U.S. PATENT DOCUMENTS 3,001,297 A 9/1961 Plumer
3,805,404 A * 4/1974 Gould ..... D06F 58/04 34/75
3,854,219 A * 12/1974 Staats ..... F26B 3/34 34/265
3,921,308 A * 11/1975 Freze ..... D02J 13/00 34/395
4,899,462 A * 2/1990 Putnam ..... D06F 58/02 34/428
5,062,219 A * 11/1991 Harris ..... D06F 58/02 34/606
5,443,541 A * 8/1995 St. Louis ..... D06F 58/30 34/486
6,678,969 B1 * 1/2004 Hong ..... D06F 58/02 34/108
7,093,377 B2 * 8/2006 Doh ..... D06F 58/04 34/596
7,647,663 B2 * 1/2010 Kim ..... D06F 29/005 8/159
7,694,434 B2 * 4/2010 Lee ..... D06F 58/04 34/607

(Continued)

FOREIGN PATENT DOCUMENTS

JP 2000024392 A 1/2000
WO WO2014023577 A1 2/2014

*Primary Examiner* — Stephen M Gravini
(74) *Attorney, Agent, or Firm* — Dority & Manning, P.A.

(57) ABSTRACT

A dryer appliance includes a cabinet. A drum is disposed within the cabinet. The drum is mounted such that the drum is fixed relative to the cabinet. The drum defines a length between a first end portion of the drum and a second end portion of the drum. The dryer appliance also includes an air duct and a fan. The air duct is coupled to the fan. The air duct has an outlet positioned at a bottom portion of the drum. The fan is operable to urge a flow of air through the air duct and into the drum at the outlet of the air duct.

20 Claims, 2 Drawing Sheets

(56) References Cited

U.S. PATENT DOCUMENTS

| | | | | |
|---|---|---|---|---|
| 8,112,903 | B2 * | 2/2012 | Favret | D06F 58/24 34/595 |
| 8,826,559 | B2 * | 9/2014 | Ahn | D06F 58/02 34/74 |
| 9,052,142 | B2 * | 6/2015 | Kim | D06F 58/22 |
| 9,133,575 | B2 * | 9/2015 | Hong | D06F 58/24 |
| 9,290,885 | B2 * | 3/2016 | Kim | D06F 58/30 |
| 9,670,613 | B2 * | 6/2017 | Ko | D06F 58/203 |
| 9,746,238 | B2 * | 8/2017 | Lim | D06F 58/02 |
| 9,920,469 | B2 * | 3/2018 | Ramprasad | D06F 58/22 |
| 10,094,065 | B2 * | 10/2018 | Kim | D06F 58/30 |
| 10,526,745 | B2 * | 1/2020 | Dunn | D06F 58/02 |
| 2005/0155251 | A1 | 7/2005 | Lee | |
| 2019/0271109 | A1 * | 9/2019 | Jung | D06F 58/24 |
| 2020/0087845 | A1 * | 3/2020 | Dunn | D06F 58/30 |
| 2020/0190726 | A1 * | 6/2020 | Jang | D06F 37/36 |

* cited by examiner

VORTEX DRYER APPLIANCE

FIELD OF THE INVENTION

The present subject matter relates generally to dryer appliances.

BACKGROUND OF THE INVENTION

Dryer appliances generally include a cabinet with a drum rotatably mounted therein. During operation, a motor rotates the drum, e.g., to tumble articles located within a chamber in the drum. Dryer appliances also generally include a heater assembly that passes heated air through the chamber in order to dry moisture-laden articles within the drum chamber.

Known dryer appliances have drawbacks. In particular, the heat and tumble action in known dryer appliances can generate significant wear in clothing. In addition, the bearings, belts, etc. necessary to rotate the drum wear out and require servicing.

BRIEF DESCRIPTION OF THE INVENTION

Aspects and advantages of the invention will be set forth in part in the following description, or may be apparent from the description, or may be learned through practice of the invention.

In an example embodiment, a dryer appliance includes a cabinet. A drum is disposed within the cabinet. The drum is mounted such that the drum is fixed relative to the cabinet. The drum defines a length between a first end portion of the drum and a second end portion of the drum. The dryer appliance also includes an air duct and a fan. The air duct is coupled to the fan. The air duct has an outlet positioned at a bottom portion of the drum. The fan is operable to urge a flow of air through the air duct and into the drum at the outlet of the air duct. The outlet of the air duct defines a length between a first end portion of the air duct and a second end portion of the air duct. The length of the outlet is about equal to the length of the drum.

In another example embodiment, a dryer appliance includes a cabinet. A drum is disposed within the cabinet. The drum mounted such that the drum is fixed relative to the cabinet. The drum defines a length between a first end portion of the drum and a second end portion of the drum. The dryer appliance also includes a fan and an air duct. The air duct is coupled to the fan. The air duct has an outlet positioned at a bottom portion of the drum. The fan is operable to urge a flow of air through the air duct and into the drum at the outlet of the air duct. The first and second end portions of the drum are spaced apart along a longitudinal direction. The outlet of the air duct has a clock position on the drum between four o'clock and seven o'clock in a cross-sectional plane of the drum that is perpendicular to the longitudinal direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
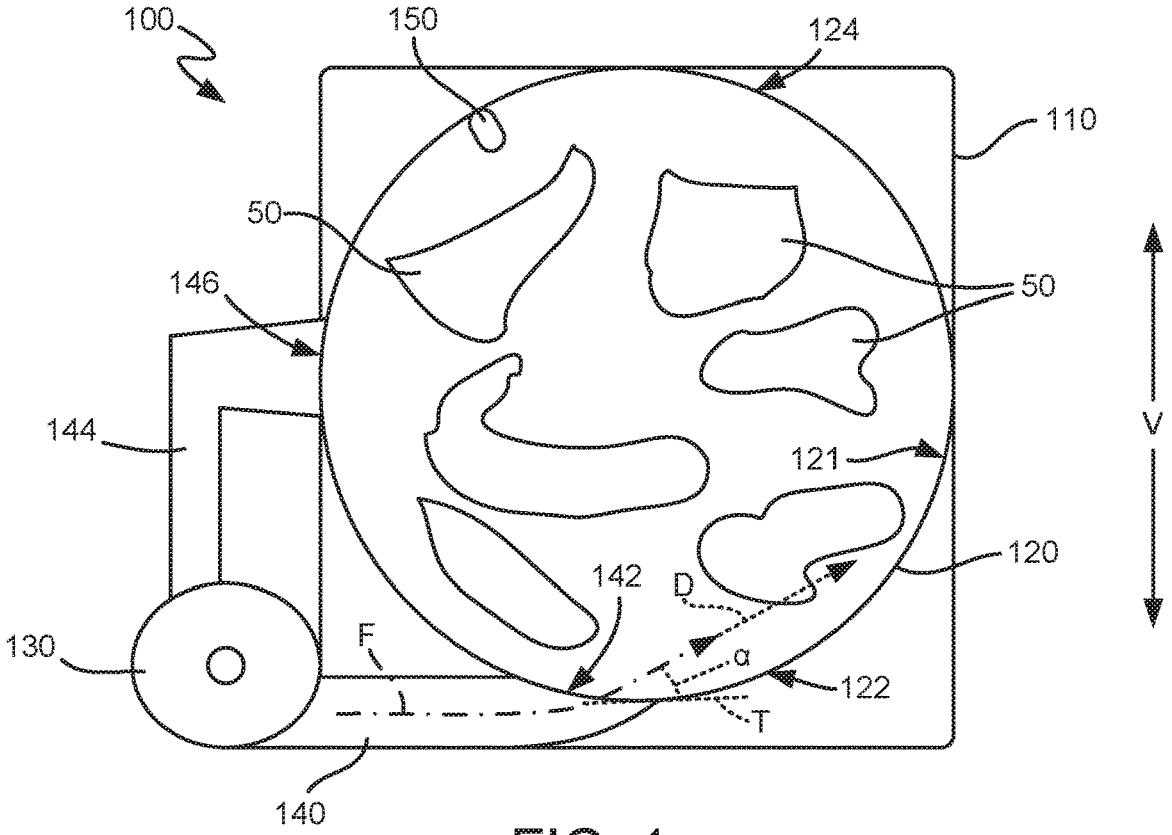
FIG. 1 is a schematic view of certain components of a dryer appliance according to an example embodiment.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a schematic view of certain components of a dryer appliance 100 according to an example embodiment. Dryer appliance 100 is operable to remove moisture from articles 50, e.g., clothing, towels, sheets, etc., disposed within dryer appliance 100. As discussed in greater detail below, dryer appliance 100 includes features for tumbling articles 50 by forced airflow within the dryer appliance 100.

With reference to FIG. 1, dryer appliance 100 includes a cabinet 110 and a drum 120. Drum 120 is disposed within cabinet 100 and is mounted such that drum 120 is fixed relative to cabinet 110. Thus, drum 120 does not rotate within cabinet 110. Drum 120 may be cylindrical and have a circular cross-sectional shape.

Dryer appliance 100 also includes a fan 130 and an air duct 140. Air duct 140 is coupled to fan 130. For example, fan 130 may be positioned within or outside cabinet 110 and may be connected to air duct 140 such that fan 130 is operable to flow air through air duct 140. In particular, air duct 140 has an outlet 142 positioned at a bottom portion 122 of drum 120. Fan 130 is operable to urge a flow of air F through air duct 140 and into drum 120 at outlet 142 of air duct 140. Fan 130 may be a radial fan, axial fan, etc. for forcing air into drum 120 at outlet 142 of air duct 140. A motor of fan 130 may be configured to operate at one-hundred and twenty volts (120 V) or two-hundred and twenty volts (220 V). In more portable embodiments, the motor of fan 130 may be configured to operate at twelve volts (12 V) or twenty-four volts (24 V). Fan 130 may be a single speed fan or a multi-speed fan.

Outlet 142 of air duct 140 may be oriented such that the flow of air F entering drum 120 through outlet 142 of air duct 140 lifts and tumbles articles 50 within drum 120 during operation of fan 130. Various features of outlet 142 of air duct 140 may assist with the lifting and tumbling of articles 50 within drum 120. For example, outlet 142 of air duct 140 may be positioned at bottom portion 122 of drum 120, and the flow of air F entering drum 120 through outlet 142 of air duct 140 may have an upward velocity component along a vertical direction V. Thus, the flow of air F entering drum 120 through outlet 142 of air duct 140 may lift articles 50 upwardly along the vertical direction V. As another example, outlet 142 maybe oriented such that the flow of air F exiting outlet 142 during operation of fan 130 has an outlet direction D, and the outlet direction D of the flow of air F may define an angle α with a tangent T of an inner surface 121 of drum 120 immediately adjacent to outlet 142. The angle α may be no less an zero degrees (0°) and no greater than forty-five degrees (45°) to assist with lifting and tumbling articles 50 within drum 120. In particularly, such orientation of the outlet 142 may advantageously lift and tumble articles 50 in drum 120 without drum 120 rotating relative to cabinet 110.

Dryer appliance 100 may also include a baffle 150 for encouraging tumbling of articles 50 in drum 120. Baffle 150 may be positioned within drum 120 at a top portion 124 of drum 120. Baffle 150 may extend from inner surface 121 of drum 120 towards an interior of drum 120, and articles 50 may impact against baffle 150 and fall downwardly along the vertical direction V during operation of fan 130. In such a manner, baffle 120 may interrupt continuous sliding of articles 50 on inner surface 121 of drum 120 and generate a tumbling action of articles 50.

Air duct 140 may also include a return section 144. Return section 144 extends from an inlet 146 of air duct 140 to fan 130 in FIG. 1. Thus, air duct 140 recirculates air through drum 120 in the embodiment shown FIG. 1. However, it will be understood that air duct 140 may vent to ambient atmosphere around cabinet 110 in alternative example embodiments, and inlet 146 may correspond to a vent opening to ambient atmosphere in such example embodiments. Inlet 146 may be positioned above outlet 142 on drum 120, e.g., along the vertical direction V. An area of inlet 146 may be selected to be greater than an area of outlet 142 of air duct 140. For example, a ratio of the area of inlet 146 to the area of outlet 142 may be greater than two (2). Thus, the inlet 146 may be at least twice as large as outlet 142 on drum 120. Such sizing may advantageously provide a higher air flow speed at outlet 142 compared to inlet 146 to assist with lifting articles 50 with the flow of air F at outlet 142.

In FIG. 1, fan 130 and air duct 140 are configured to circulate ambient temperature air through drum 120. Thus, dryer appliance 100 does not include a heating element, such as electric resistance heating element, gas burner, etc., for increasing the temperature of air entering drum 120 at outlet 142. As may be seen from the above, dryer appliance 100 may efficiently dry articles 50 without requiring conventional energy intensive heating elements and rotating drums.

Figure 2:
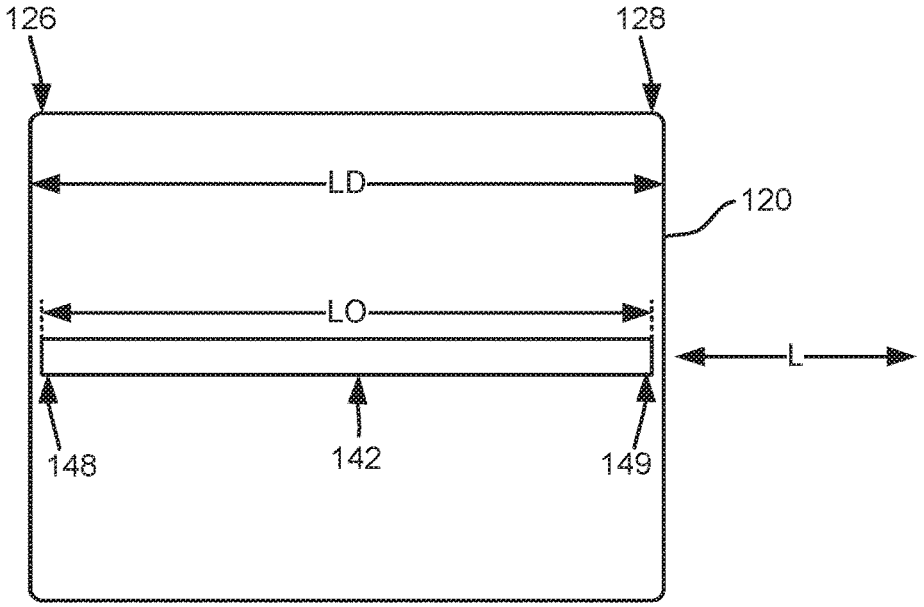
FIG. 2 is a schematic view of a drum of the example dryer appliance of FIG. 1.

FIG. 2 is a schematic view of drum 120. Additional features of outlet 142 that facilitate lifting and tumbling of articles 50 within drum 120 during operation of fan 130 are discussed in greater detail with reference to FIG. 2. As shown in FIG. 2, drum 120 defines a length LD between a first end portion 126 of drum 120 and a second end portion 128 of drum 120. First and second end portions 126, 128 of drum 120 are spaced apart along a longitudinal direction L. In particular, first and second end portions 126, 128 of drum 120 may be positioned opposite each other along the longitudinal direction L. Outlet 142 of air duct 140 also defines a length LO between a first end portion 148 of outlet 142 and a second end portion 149 of outlet 142. First and second end portions 148, 149 of outlet 142 are spaced apart along the longitudinal direction L. In particular, first and second end portions 148, 149 of outlet 142 may be positioned opposite each other along the longitudinal direction L. The length LO of outlet 142 may be about equal to the length LD of drum 120. As used herein, the term "about" means within twenty percent of the stated length when used in the context of lengths. As may be seen from the above, the outlet 142 may extend along the length LD of drum 120. Such sizing of outlet 142 on drum 120 may advantageously facilitate uniform tumbling of articles 50 in drum 120.

Figure 3:
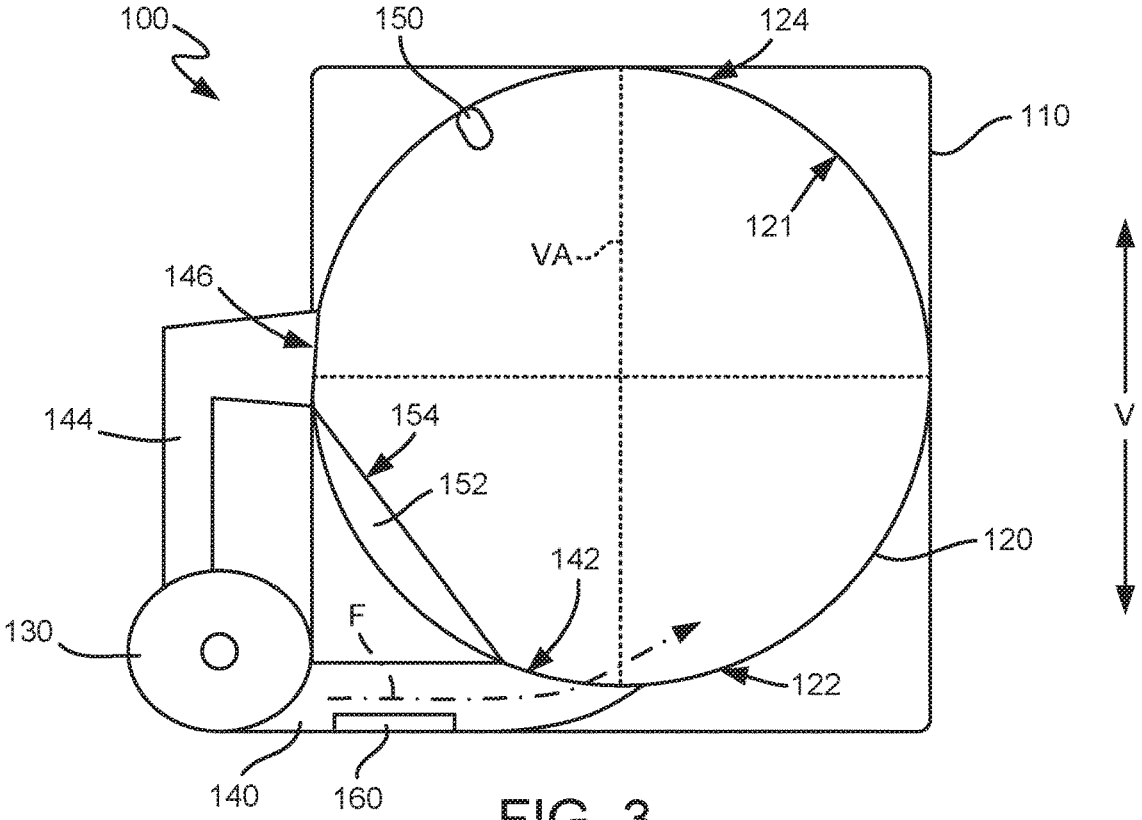
FIG. 3 is a schematic view of certain components of a dryer appliance according to another example embodiment.

FIG. 3 is a schematic view of certain components of dryer appliance 100 according to another example embodiment. As discussed in greater detail in the context of FIG. 3, outlet 142 of air duct 140 may be positioned to facilitate circulation of air in drum 120. For example, outlet 142 of air duct 140 may have a clock position on drum 120 between four o'clock (4:00) and seven o'clock (7:00) in a cross-sectional plane of drum 120 that is perpendicular to the longitudinal direction L. Thus, e.g., outlet 142 of air duct 140 may be positioned between one-hundred and twenty degrees (120°) and two-hundred and twenty degrees (210°), as measured from a vertical axis VA passing through a center of drum 120 starting from top portion 124 of drum 120 and proceeding in a clockwise direction. Inlet 146 of air duct 140 may also be positioned to complement the position of outlet 142 and facilitate circulation of air in drum 120. For example, inlet 146 of air duct 140 may have a clock position on drum 120 between seven o'clock (7:00) and ten o'clock (10:00) in the cross-sectional plane of drum 120 that is perpendicular to the longitudinal direction L. Thus, e.g., inlet 146 of air duct 140 may be positioned between two-hundred and ten degrees (210°) and three-hundred degrees (300°), as measured from the vertical axis VA passing through the center of drum 120 in the manner described above.

In FIG. 3, dryer appliance 100 includes a heating element 160, e.g., an electric resistance heating element, gas burner, etc., that is operable to heat air circulating through drum 120. For example, heating element 160 may be positioned in air duct 140 and heat the flow of air F in air duct 140. Compared to the embodiment shown in FIG. 1, heating element 160 may increase a drying rate for articles 50 in drum 120 at the expense of the energy consumption of heating element 160.

Dryer appliance 100 also includes a guide panel 152 in FIG. 3. Guide panel 152 is positioned within drum 120, e.g., below baffle 150. Guide panel 152 is sloped towards outlet 142 of air duct 140. For example, guide panel 152 may have a flat outer surface 154 that faces an interior of drum 120. Articles 50 may slide on flat outer surface 154 towards outlet 142 of air duct 140. In particular, articles 50 may impact baffle 150 and fall downwardly onto guide panel 152, and the articles 50 may slide on flat outer surface 154 towards outlet 142 of air duct 140. The shape and angling of guide panel 152 relative to the arcuate inner surface of drum 120 may encourage movement of articles 50 towards outlet 142 of air duct 140. Guide panel 152 may extend from a clock position on drum 120 of about six o'clock (6:00) to about nine o'clock (9:00) in a cross-sectional plane of drum 120 that is perpendicular to the longitudinal direction L. As used herein, the term "about" means within one hour of the stated clock position when used in the context of clock positions. Thus, e.g., guide panel 152 may extend on the inner surface 121 of drum 120 from about one-hundred and eighty degrees (180°) to about two-hundred and seventy degrees (270°), as measured from the vertical axis VA passing through the center of drum 120 starting from top portion 124 of drum 120 and proceeding in a clockwise direction.

Figure 4:
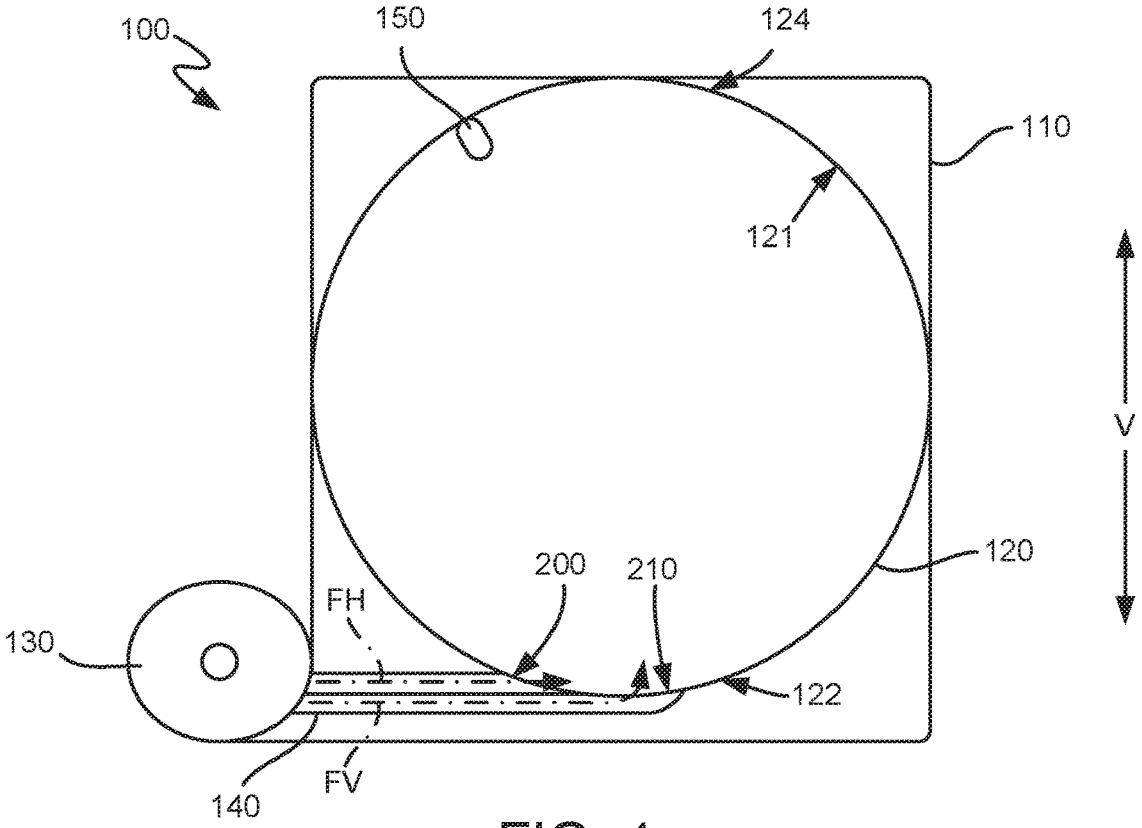
FIG. 4 is a schematic view of certain components of a dryer appliance according to yet another example embodiment.

FIG. 4 is a schematic view of certain components of dryer appliance 100 according to yet another example embodiment. In FIG. 4, air duct 140 includes two separate outlet sections, a first outlet section 200 and a second outlet section 210. First outlet section 200 is oriented for direction a flow of air FH along a horizontal direction that is perpendicular to the longitudinal direction L and the vertical direction V, and second outlet section 220 is oriented for direction a flow of air FV along the vertical direction V. The bi-duct arrangement of FIG. 4 may facilitate lifting and tumbling of articles in drum 120.

In dryer appliance 100, inner surface 121 of drum 120 may be covered with a fabric, wool or felt lining. Such lining may facilitate drying of articles 50 in drum 120. For example, the fabric, wool or felt lining may absorb water from damp articles 50 in drum.

As may be seen from the above, dryer appliance 100 uses the whirling effect of fan 130 blowing air F into a stationary drum 120 to dry articles 50 in the drum 120. The articles 50 are lifted and rotated by the air F blown into drum 120 at a suitable angle by fan 130. The air F enters drum 120 through inlet 142 in order to get suitable lifting and whirling effects for the articles 50. Dryer appliance 100 has numerous advantages over known dryer appliances including reduced wear of articles 50 and reduced maintenance/servicing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, comprising:

a cabinet;

a drum disposed within the cabinet, the drum mounted such that the drum is fixed and not rotatable relative to the cabinet, the drum defining a length between a first end portion of the drum and a second end portion of the drum;

a fan;

an air duct coupled to the fan, the air duct having an outlet positioned at a bottom portion of the drum, the fan operable to urge a flow of air through the air duct and into the drum at the outlet of the air duct, the outlet of the air duct defining a length between a first end portion of the air duct and a second end portion of the air duct, wherein the length of the outlet of the air duct is about equal to the length of the drum.

2. The dryer appliance of claim 1, wherein the outlet is oriented such that air exiting the outlet of the air duct during operation of the fan has an outlet direction, the outlet direction defining an angle $\alpha$ with a tangent of an inner surface of the drum immediately adjacent to the outlet, the angle $\alpha$ being no less than zero degrees and no greater than forty-five degrees.

3. The dryer appliance of claim 1, wherein the first and second end portions of the drum are spaced apart along a longitudinal direction, and the outlet of the air duct has a clock position on the drum between four o'clock and seven o'clock in a cross-sectional plane of the drum that is perpendicular to the longitudinal direction.

4. The dryer appliance of claim 3, wherein the air duct has an inlet positioned above the outlet of the air duct on the drum.

5. The dryer appliance of claim 4, wherein the inlet of the air duct has a clock position on the drum between seven o'clock and ten o'clock in the cross-sectional plane of the drum that is perpendicular to the longitudinal direction.

6. The dryer appliance of claim 1, wherein the air duct has an inlet positioned above the outlet of the air duct on the drum.

7. The dryer appliance of claim 6, wherein an area of the inlet of the air duct is greater than an area of the outlet of the air duct.

8. The dryer appliance of claim 7, wherein a ratio of the area of the outlet of the air duct to the area of the inlet of the air duct is greater than two.

9. The dryer appliance of claim 1, further comprising a baffle positioned within the drum at a top portion of the drum.

10. The dryer appliance of claim 9, further comprising a guide panel positioned within the drum below the baffle, the guide panel sloped towards the outlet of the air duct.

11. The dryer appliance of claim 1, wherein the outlet of the air duct is oriented such that air entering the drum through the outlet of the air duct lifts and tumbles articles within the drum during operation of the fan.

12. The dryer appliance of claim 11, wherein the fan and the air duct are configured to circulate ambient temperature air through the drum.

13. The dryer appliance of claim 11, further comprising a heating element operable to heat air circulating through the drum.

14. The dryer appliance of claim 11, further comprising a fabric, wool or felt lining covering an inner surface of the drum.

15. A dryer appliance, comprising:

a cabinet;

a drum disposed within the cabinet, the drum mounted such that the drum is fixed and not rotatable relative to the cabinet, the drum defining a length between a first end portion of the drum and a second end portion of the drum;

a fan;

an air duct coupled to the fan, the air duct having an outlet positioned at a bottom portion of the drum, the fan operable to urge a flow of air through the air duct and into the drum at the outlet of the air duct, wherein the first and second end portions of the drum are spaced apart along a longitudinal direction, and the outlet of the air duct has a clock position on the drum between four o'clock and seven o'clock in a cross-sectional plane of the drum that is perpendicular to the longitudinal direction.

16. The dryer appliance of claim 15, wherein the outlet of the air duct defines a length between a first end portion of the air duct and a second end portion of the air duct, and the length of the outlet of the air duct is about equal to the length of the drum.

17. The dryer appliance of claim 15, wherein the outlet is oriented such that air exiting the outlet of the air duct during operation of the fan has an outlet direction, the outlet direction defining an angle $\alpha$ with a tangent of an inner surface of the drum immediately adjacent to the outlet, the angle $\alpha$ being no less an zero degrees and no greater than forty-five degrees.

18. The dryer appliance of claim 15, wherein the air duct has an inlet positioned above the outlet of the air duct on the drum, and the inlet of the air duct has a clock position on the drum between seven o'clock and ten o'clock in the cross-sectional plane of the drum that is perpendicular to the longitudinal direction.

19. The dryer appliance of claim 15, wherein the air duct has an inlet positioned above the outlet of the air duct on the drum, and an area of the inlet of the air duct is greater than an area of the outlet of the air duct.

20. The dryer appliance of claim 15, wherein the outlet of the air duct is oriented such that air entering the drum through the outlet of the air duct lifts and tumbles articles within the drum during operation of the fan.

* * * * *